US006435932B1

(12) United States Patent
Lynn

(10) Patent No.: US 6,435,932 B1
(45) Date of Patent: Aug. 20, 2002

(54) MODEL SPACE CRAFT GLIDER

(76) Inventor: Anthony Lynn, 2109 Montel Paiement, Val des Monts, Quebec (CA), J8N 7B9

( * ) Notice: Subject to any disclaimer, the term of this patent is extended or adjusted under 35 U.S.C. 154(b) by 0 days.

(21) Appl. No.: 09/898,915

(22) Filed: Jul. 3, 2001

(51) Int. Cl.[7] ..... A63H 27/04

(52) U.S. Cl. ..... 446/30; 446/31; 446/34; 446/56; 446/61

(58) Field of Search ..... 446/61, 68, 56, 446/57, 34, 30, 31, 230, 231, 63; 244/35 R, 198, 219

(56) References Cited

U.S. PATENT DOCUMENTS

| | | | | | |
|---|---|---|---|---|---|
| 1,547,644 | A | * | 7/1925 | Cronstedt | 244/35 R |
| 1,802,283 | A | * | 4/1931 | Simmonds | 244/124 |
| 1,877,120 | A | * | 9/1932 | Boehme | 446/57 |
| 1,981,701 | A | * | 11/1934 | Hoffman | 244/35 R |
| 4,248,007 | A | * | 2/1981 | Gamburd | 244/16 |
| 4,531,323 | A | * | 7/1985 | Henning | 244/34 A |
| 5,090,636 | A | * | 2/1992 | Sadowski | 244/16 |
| 5,324,222 | A | * | 6/1994 | Chen | 446/34 |

FOREIGN PATENT DOCUMENTS

| | | | |
|---|---|---|---|
| GB | 2270478 | * | 3/1994 |

* cited by examiner

*Primary Examiner*—Jacob K. Ackun
*Assistant Examiner*—Bena B. Miller
(74) *Attorney, Agent, or Firm*—Thomas A. Beck; Baker & Rannells

(57) ABSTRACT

A model space vehicle having a fixed circular wing, streamlined fuselage, fins with booms attached thereto all efficiently configured to result in an article possessing suitable aerodynamic properties to enable it to glide smoothly through the air for a substantial period of time and substantial distance relative to its size and weight.

13 Claims, 8 Drawing Sheets

MODEL SPACE CRAFT GLIDER

BACKGROUND OF THE INVENTION

1. Field of the Invention

The present invention relates to a model space vehicle configured to possess suitable aerodynamic properties such that it is capable of gliding smoothly through the air for a substantial period of time relative to its size and weight.

2. Description of the Prior Art

Over the years conventional aircraft have taken shapes in many forms using fixed wings and tail plane of various platforms. The most commnon wing shapes are rectangular, swept back and delta with varying cross sectional and wing surface areas. Other more recent embodiments include aircraft which have wings which are movable to vary the angle of sweep while others have wings tilting on a horizontal axis to vary the angle of attack.

The aircraft wing is modified in a VTOL (vertical take off and landing) and a STOL (short take off and landing) and is generally a function of the propulsion unit used in conjunction with the aircraft.

There has been a suggestion that a rotating circular wing can be used effectively on an aircraft. Further, the thought is, that if the circular wing were fixed and not rotating, it would have such poor pitch stability that the circular wing could only be placed at the rear of the aircraft. This hypothesis is not accurate insofar as the instant application is concerned In order for an object to fly through the air it must have some type of wing which constitutes an efficient airfoil. A typical cross section of a wing having an airfoil shape is depicted in FIG. 13.

FIG. 13 shows that as the wing through the air, the air divides to pass around the wing. The airfoil is curved so that the air passing above the wing moves faster than the air passing beneath. Fast moving air creates a lower pressure than slow moving air. According to the principle of Bernoulli, the pressure of the air is therefore greater beneath the wing than above it. This difference in air pressure forces the wing upward. This force is called "lift."

Besides lift, heavier than air machines (with and without engines) achieve flight by generating a force which overcomes their weight and supports them in air. For example, VTOL aircraft direct the power of their jet engines downward and heave themselves off of the ground by brute force.

The flying craft of the presence invention is a model space craft which does not contain an engine. The flying craft of the present invention functions as a glider, although its construction is unorthodox since it does not have the appearance of a typical glider.

External means of propulsion can optionally be used in conjunction with the model. For example, powered flight may be achieved in the craft of the present invention using jet turbine type engines in the form of ducted fan propulsion units for model aircraft. These may be placed on the craft in various positions.

A glider is the simplest type of winged aircraft. The typical glider has long straight wings that produce high lift at very low speed. It is pulled or thrust along the ground until it is moving fast enough that the lift generated by the "wings" exceeds its weight. When this occurs, the glider then rises into the air and flies. After release, from towing or thrusting means, the glider concurrently continues to move forward while it drops slowly pulled by a thrust force due to gravity. Friction with the air produces a forces called "drag" which acts to hold the glider back. These two pairs of opposing forces—lift and weight, thrust and drag- act on all aircraft. Aerodynamicists struggle with the opposing forces noted above in their efforts to improve aviation. The swept back wings referred to above in a jet engine aircraft are needed to minimize drag at high speeds. However lift is also reduced, requiring high take off and landing speeds.

The aforementioned forces were all considered in developing the craft of the present invention The predicate for the configuration of the flying craft of the present invention is a fictional space craft which has not been a flying craft and is in fact only a fictional means for space travel. The present invention has an appearance similar to the "U.S.S. STARSHIP ENTERPRISE."

By substantially adopting the design and adhering to basic principles of aerodynamics and principles of flight, some of which are described above, it is possible to construct a glider model which is able to fly as well as any glider, conventional or otherwise, found in the prior art. However, in keeping with the aerodynamic principles mentioned above, one would expect that a cross-sectional view of the non-symmetrical airfoil of the aircraft would display a profile wherein the upper surface of the foil, as depicted in FIG. 14 has an eccentricity (e) value (i.e., the extent of curvature of the surface, having a value between zero and 1, wherein zero is the extent of curvature found in a circle and 1 is a straight line) that is less than the eccentricity value of the lower surface of the airfoil. Contrary to the conventional principles of aerodynamic technology set forth above, the upper surface of the airfoil of the present invention, as shown in FIG. 12 has an eccentricity value which is greater than the eccentricity value of, the lower surface of the airfoil. Thus the airfoil of the present invention has an upper surface that is shallower than the lower section thereof.

Other objects and features as well as additional details of the present invention will become apparent from the following detailed description and annexed drawings of the presently preferred embodiments thereof, when considered in conjunction with the associated drawings.

SUMMARY OF THE PRESENT INVENTION

The present invention embodies the criteria discussed above and result in a model space craft suitable for gliding having the following elements;

- a fixed circular wing means for providing lift, having a topside and an underside and a thickness,
- as shown in FIG. 12, the underside of the fixed circular wing is more convex than the topside of the circular wing;
- the fixed circular wing having an approximate diameter 8 times that of its thickness;
- a streamlined fuselage which extends fore and aft along a longitudinal axis about
- which the model space craft can assume a roll attitude;
- it has connecting means extending from said underside of said circular wing, protruding downward and rearward and attached to a fore section location on the streamlined fuselage;
- the streamlined fuselage having a tapered profile toward the aft section thereof,
- the streamlined fuselage being re-enforced using a lightweight stress bearing strut extending the length of the fuselage (as shown in FIG. 4); that is, from the point of the fuselage where it meets the circular wing to the rear of the fuselage;
- a pair of fins protruding from opposite sides of said streamlined fuselage and positioned and fixed at a first end to said aft section of said streamlined fuselage, and extending outward radially at an angle of approximately 40 degrees from the vertical axis and rearward at an angle of approximately 30 degrees to the vertical;

each fin is approximately 4 times wider than its thickness and having a streak profile to promote effective stability to the model space craft;

each fin at its upper end supports a boom at a height above the horizontal plane of said circular wing so as to avoid the booms being subjected to the turbulence which is produced by airflow over the airfoil which is a circular wing; the relative dimensions of the length, width and thickness of each boom is approximately 5 times as long as it is wide and approx 4 times wider than it is thick;

each boom comprises a flat underside and a domed topside with a rearward taper;

each boom lies on a horizontal plane parallel to the horizontal plane of said fixed circular wing with a slight tilt of 1.0 to 1.5 degrees clockwise (i.e., from the horizontal plane as depicted in FIG. 3(*a*)) viewed from the left side of the model space ship;

the ballast is positioned in the foresection of the circular wing so as to achieve a center of gravity point which will be approximately two thirds the diameter of the airfoil (circular wing), measured from the leading edge of the airfoil (circular wing).

The fuselage of the model space craft as described above is comprised of single or multiple sections with additional support internally or externally. The model space craft may be powered by propulsion means selected from the group consisting of electric, combustible fuel, elastic or compressed air, where the propulsion means is mounted internally or externally; or the propulsion units are attached or detached from the craft. Alternative means for propulsion are catapult, by throwing or by a manually powered device.

While it is intended that the invention relate to a model space craft, in addition to being a flying toy, it can also be a flying commercial vehicle, a flying recreational vehicle, a flying military vehicle, or a flying scientific vehicle.

BRIEF DESCRIPTION OF THE DRAWINGS

The present invention will be more fully understood by reference to the following detailed description of the preferred embodiment of the present invention when read in conjunction with the accompanying drawings, in which like reference characters refer to like parts throughout the views and in which:

FIG. 3(*a*) is a side view depicting the angled position of the boom with respect to the circular wing along the horizontal axes of each, as well as the approximate locations of the optimum ballast location and center of gravity of the airship.

DETAILED DESCRIPTION OF THE PREFERRED EMBODIMENT

Figure 1:
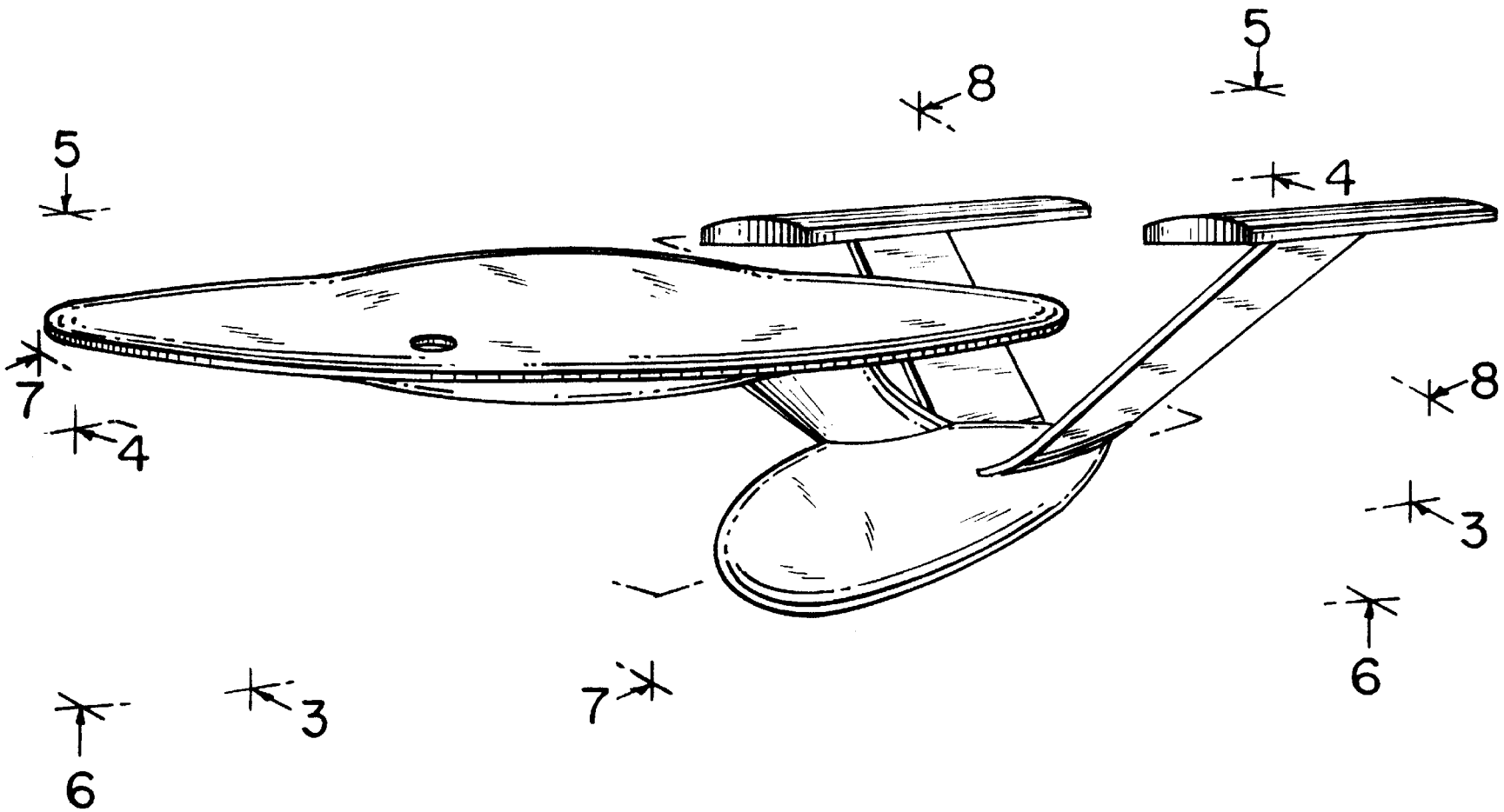
FIG. 1 is a perspective view of the craft of the present invention.
Figure 13:
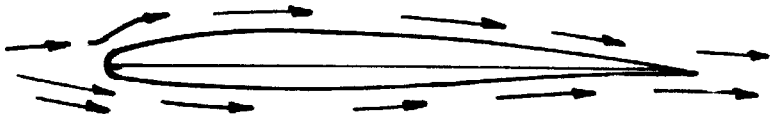
FIG. 13 is a side plan view of a typical airfoil showing the airflow about the upper and lower surfaces.

FIG. 1 shows a perspective view of the basic shape of the model glider aircraft which is successfully airworthy in flight in this form FIG. 13 represents the typical airfoil for an aircraft. It depicts the airflow impacting on the leading edge of the wing. The airflow splits at the leading edge flowing around the upper and lower surfaces. This design produces a lower pressure on the topside than is produced on the underside. The faster moving airflow creates a lower pressure area above the wing and the slower moving airflow results in a pressure difference between the upper and lower surfaces resulting in "LIFT." The idea is that the air passing over the topside does so faster than the air passing the underside because the air has further to travel on top. The reason that the air has further to travel is because of the increase in surface area on top to that of the underside.

Figure 14:
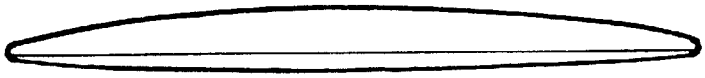
FIG. 14 is a side plan view of the circular wing found in a prior art craft. on the original design.

FIG. 14 represents a cross sectional view of the proposed airfoil disclosed in British Publication No. GB2270478. In this embodiment, clearly the top is substantially more convex than the underside. Surprisingly, in view of the design of the conventional airfoil, models made utilizing this configuration could become airborne. The ratio of the upper to lower airfoil surfaces is in the range of between about 1.0 to about 0.85 respectively. However the one major drawback was that the airfoil produced a lift that a sizable piece of lead was needed to allow the craft to glide. Thus it did not have the control that the conventional airfoil does. As with all model aircraft, within limits, the heavier the craft, the faster it will fly. There was no exception for models utilizing this airfoil design. The firer and heavier a craft, the harder it will land. Models having this airfoil design broke, irrespective of materials and design due to their momentum upon impact.

Figure 12:
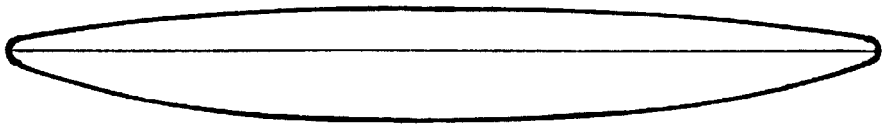
FIG. 12 is a side plan view of the circular wing of the present invention

The cross sectional view of the novel airfoil of the present invention is depicted in FIG. 12. The Figure shows a disc in cross sectional view in which the upper side is less convex than that of the underside using a horizontal line representing the circumference or edge of the airfoil. With respect to the novel airfoil of the present invention, the ratio of the upper to lower airfoil surfaces is in the range of between about 0.85 to about 1 respectively. This novel airfoil design allowed a reduction of the minimum ballast requirements in order to obtain the capability to glide and land smoothly. The fact that the model craft could in fact glide for a substantial time and distance is totally unexpected. Based upon longing aerodynamic principles, one would expect that a reverse effect would be obtained if one used a more convex underside. Conventional wisdom in this field would be that such a design is impractical insisting the airfoil design should force the craft to the floor rather than providing lift enabling it to soar. Actual test results with models of the model spacecraft have established its air worthiness so as to substantiate the above-noted ratio of the convex upper and lower surfaces of the airfoil.

Referring to prior art British Publication No. GB2270478, the booms on the glider disclosed therein are cylindrically shaped. Test results have established that using cylindrical shaped booms of the prior art design on a "flying"model (i.e., a model having the design of the fictional U.S.S. Enterprise which is subjected to test flights) will render the craft totally unable to fly. The then solution developed to cure the defect was to make the booms domed. The most efficient aerodynamic design was to make the booms essentially flat so that they do not act like a bluff body to the oncoming airflow.

Figure 2:
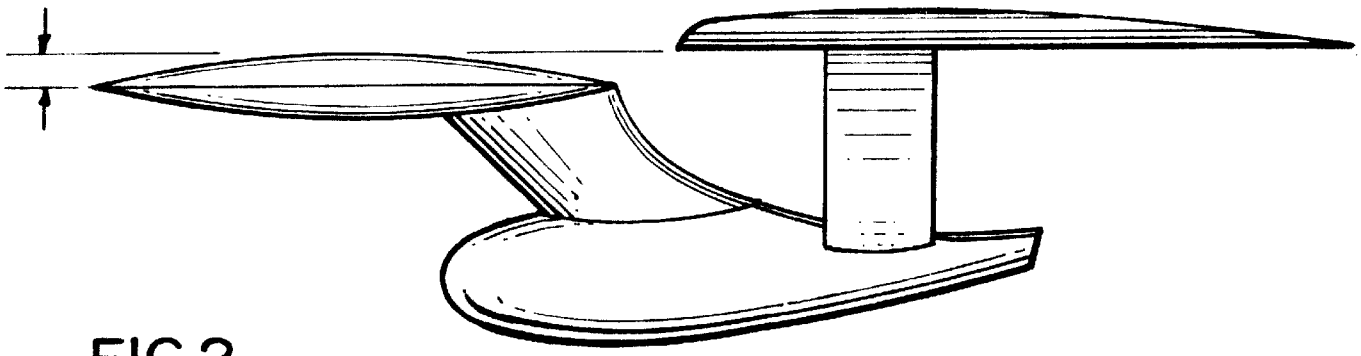
FIG.2 PRIOR ART
FIG. 2 is a side view of the prior art.
Figure 7:
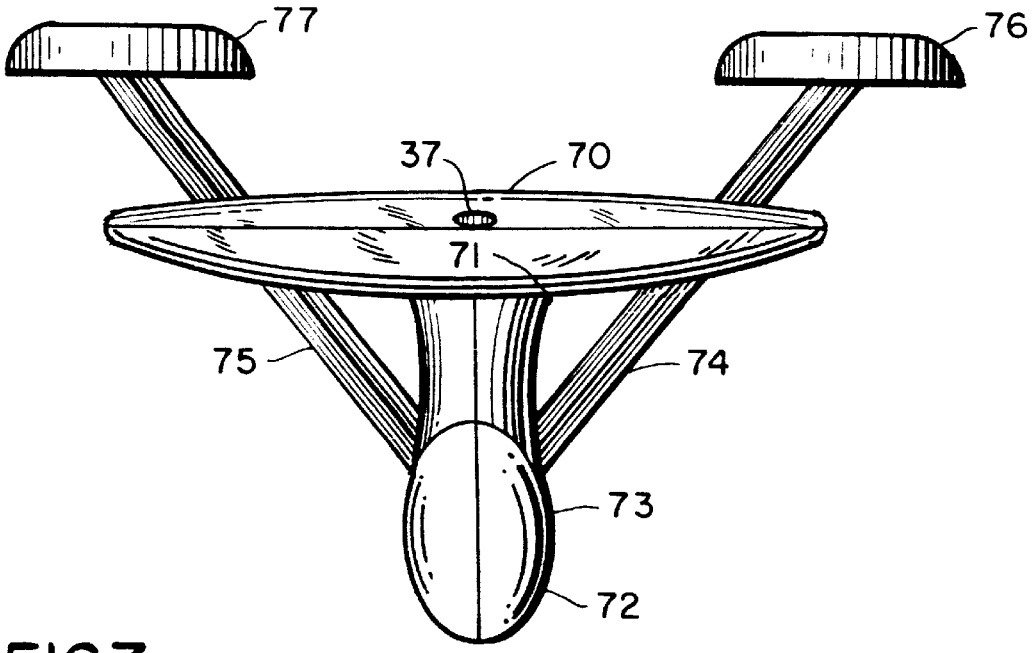
FIG. 7 is a front plan view of the craft of the present invention.
Figure 8:
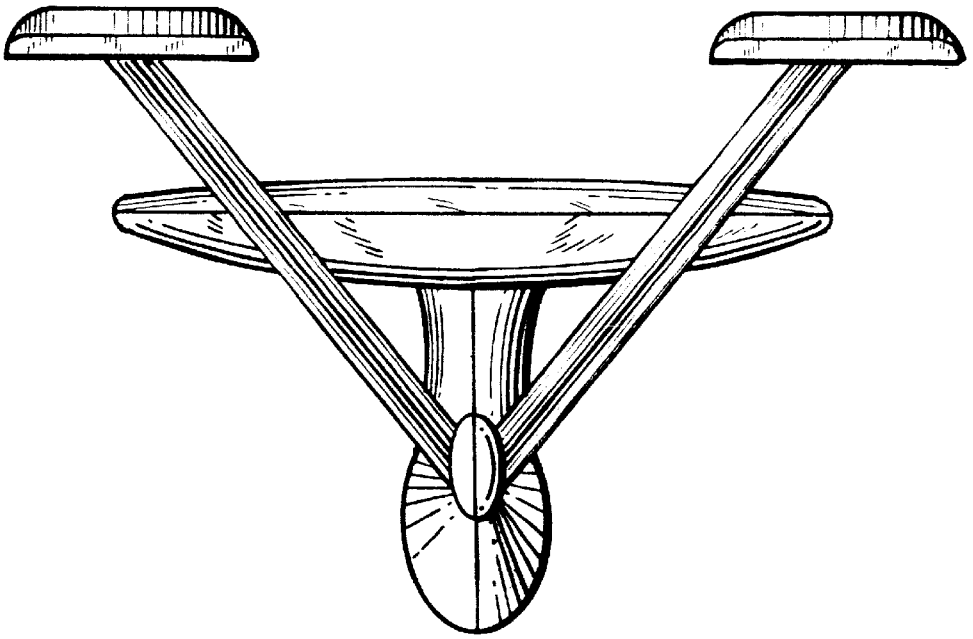
FIG. 8 is a rear plan view of the craft of the present invention.

More specifically, as a result of a pragmatic approach to the problem with respect to the booms, definite improvements were confirmed when the underside of the booms was flat and not convex. FIG. 7 depicts a front view of the model spacecraft showing that disc foil 70 is attached at its lower surface 71 to fuselage 72. Extending obliquely from side 73 of fuselage 72 are fins 74 and 75. At the distal end of each fin is attached horizontal booms 76 and 77; the distance between disc and boom is greater than the prior art device depicted in British Publication GB2270478. This greater distance results in a reduced influence of the drag from the disc on the boom. FIG. 2 (prior art) and FIG. 3 (present invention) depict the differences in distance and in height. FIG. 8 depicts a rear view of the spacecraft.

Figure 3:
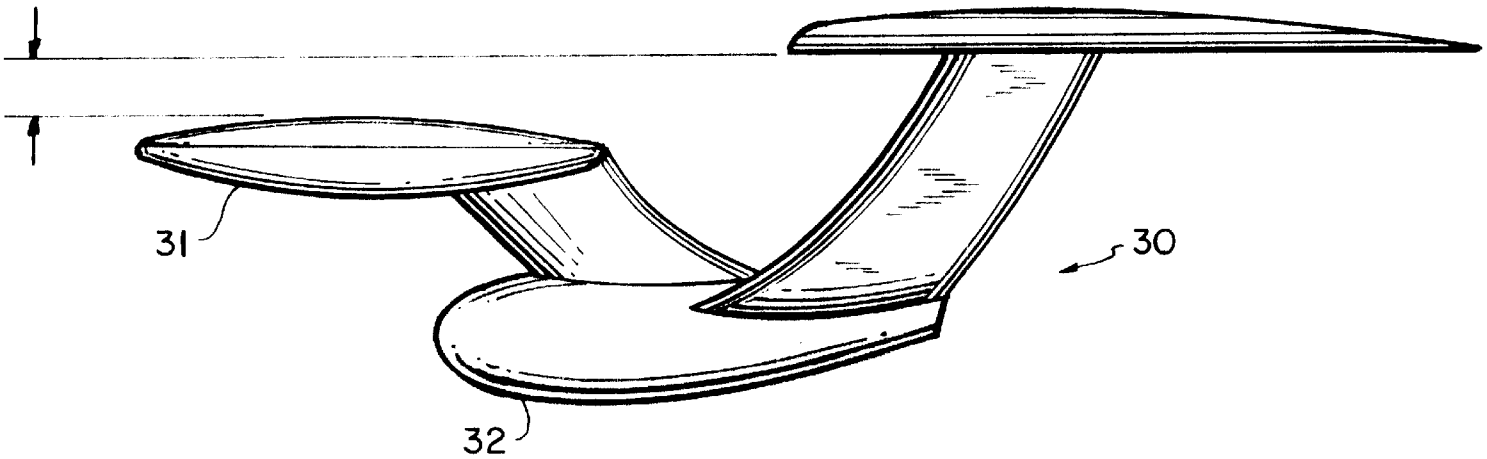
FIG. 3 is a side view of the craft of the present invention.
Figure 3A:
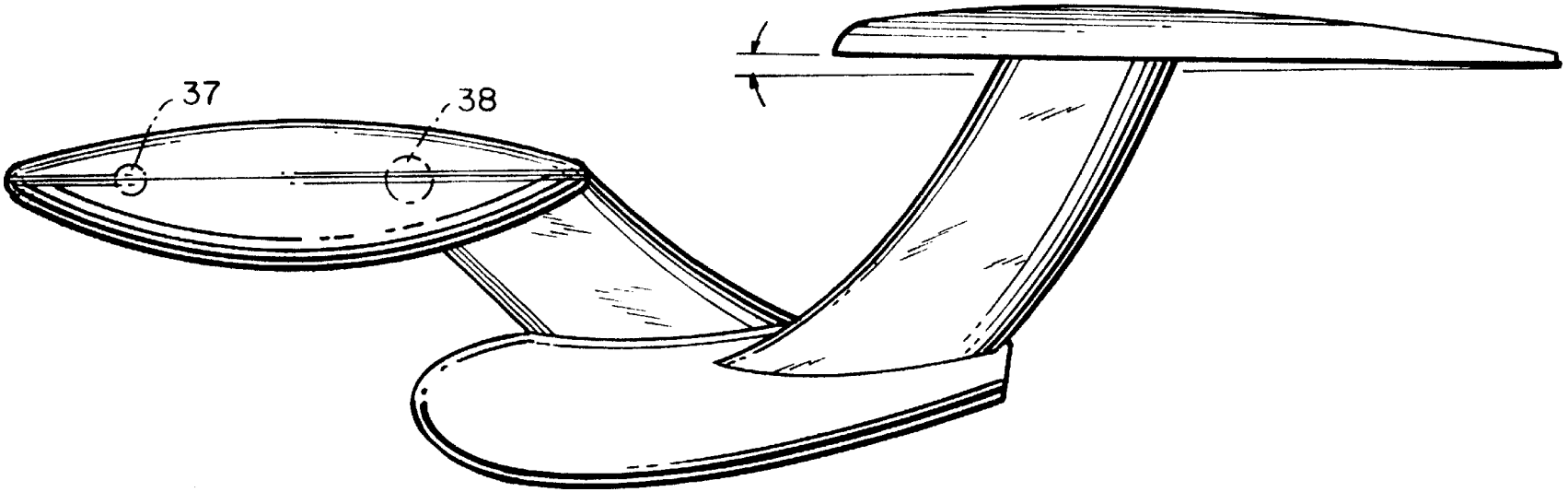

FIG. 3 depicts a side view of the structure of the improved model spacecraft (30). This view shows the relative spatial relationship of horizontal disc foil (31), fuselage (32), fins (33)(Only one depicted) and its relative width, and boom having the flat underside described above. As noted above, compared with the prior art model spacecraft disclosed in publication GB2270478, the distance(horizontal planar distance)between disc foil and the boom is increased in the present invention to reduce the influence of the drag from the disc foil on the boom. The fins play an important role in the ability of the model spacecraft to fly. They must show a streamline profile with respect to their thickness (analogous to their diameters) and their dimension from the leading edge exposed to the oncoming air flow to their trailing edge.

The improvement is further enhanced by implementing a slight tilt to the horizontal plan of the booms of 1.5 degrees with respect to the horizontal plane of the disc. FIG. 3(*a*) is a close-up depicting the tilt of the booms with respect to the horizontal plane of the disc airfoil. The booms are tilted upward between 1 degree and 1.5 degrees from the horizontal plane.

FIG. 3(*a*) also indicates the approximate location of the optimum ballast location (37) and the center of gravity (38) of the aircraft.

Although the model space craft would glide efficiently under virtually all conditions, the ability to perform acrobatic stunts with the model craft disclosed in British Publication 2270478 was limited. It was determined that the booms presented to some extent, a "bluff body" profile to the onrushing slipstream which resulted in air deflection with eddy currents and thus increased drag. A "loop the loop" acrobatic stunt with the model was difficult to achieve consistently. To achieve a "loop the loop", the model needs to be thrown fast. Knowing that the disc airfoil is fixed in place (i.e., not rotating like a Frisbee), there will be a great deal more turbulence, so an increase was made to the height of the booms with respect to the airfoil disc. This specific embodiment of the present invention is depicted in FIG. 3. This improvement resulted in the ability to perform acrobatic stunts as well as straight course gliding.

The fuselage (32) in FIG. 3 is the central element in the structure of model spaceship. A fragile fuselage will lead to a high model mortality rate if thrown hard or fast. Attempts have been made in the past to improve the durability of the fuselage in the model starship by employing a greater cross sectional dimension so as to decrease the vulnerability of the model spacecraft to fracture in flight or upon landing. This attempt resulted in the part being wider and only served to hinder its flight. It has been determined experimentally that increasing the thickness of the fuselage impairs its ability to fly.

Figure 4:
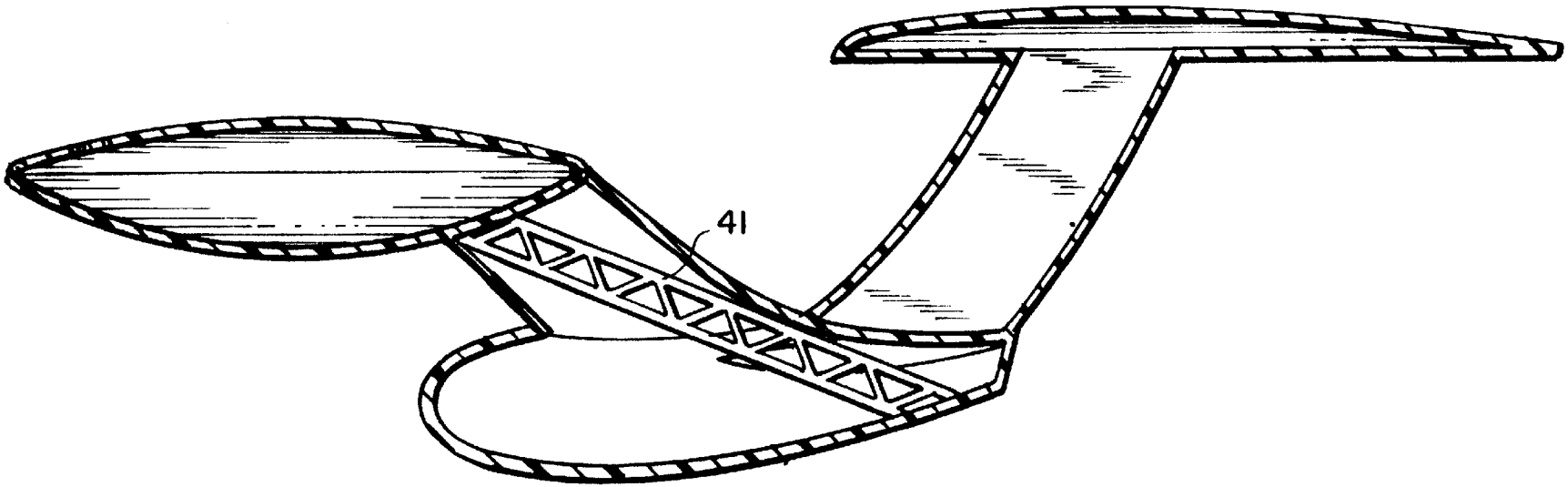
FIG. 4 is a is a cutaway side view of the craft of the present invention showing a reinforcing spar within the fuselage.
Figure 5:
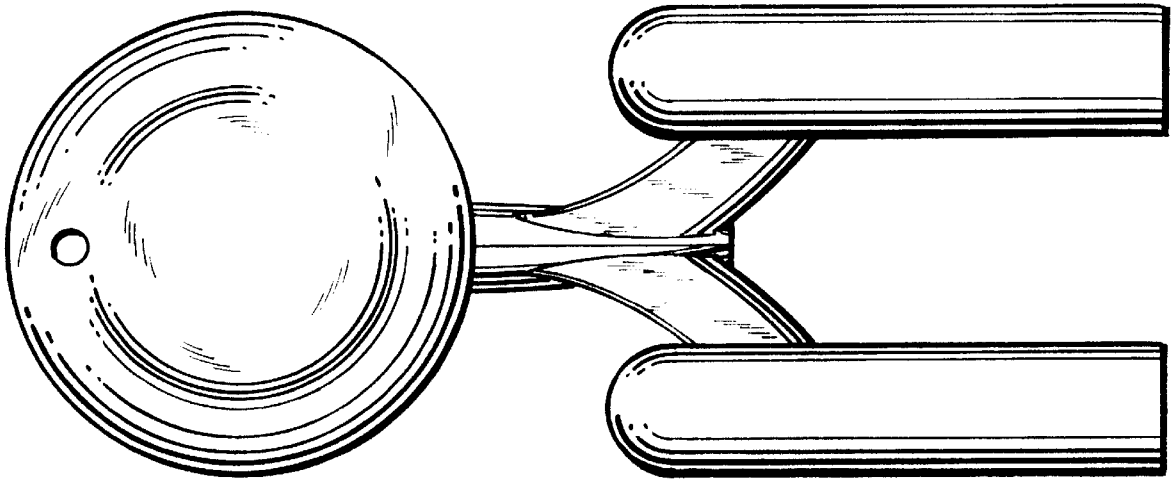
FIG. 5 is a top plan view of the craft of the present invention.
Figure 6:
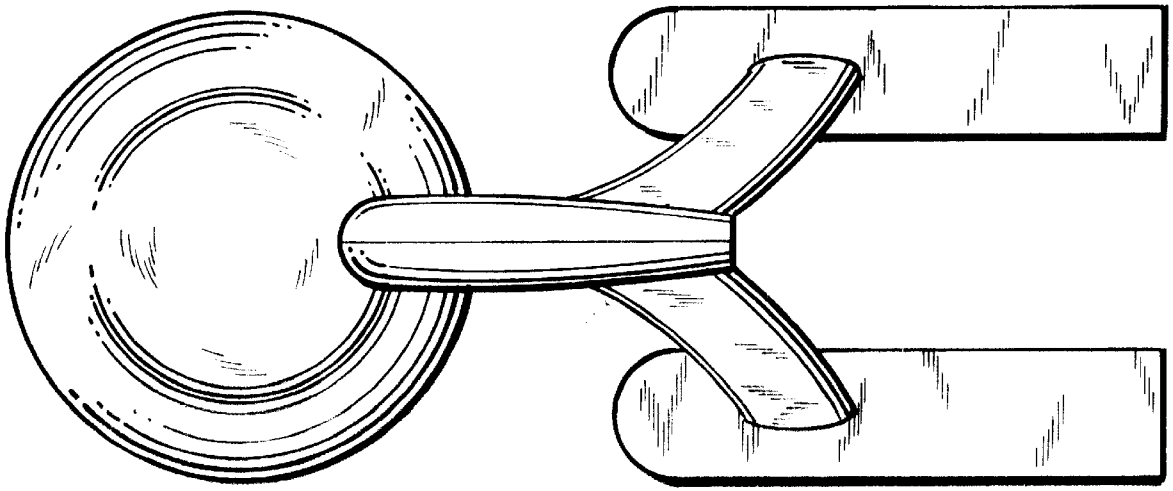
FIG. 6 is a bottom plan view of the craft of the present invention.

The fuselage associated with the model space craft of the present invention is re-enforced with a small piece of substantially rigid plastic which can conveniently be any natural or synthetic polymeric material having a density conducive to allowing the glider to fly. The improved fuselage with the rigid plastic spine/brace (41) in place is shown in FIG. 4.

Figure 9:
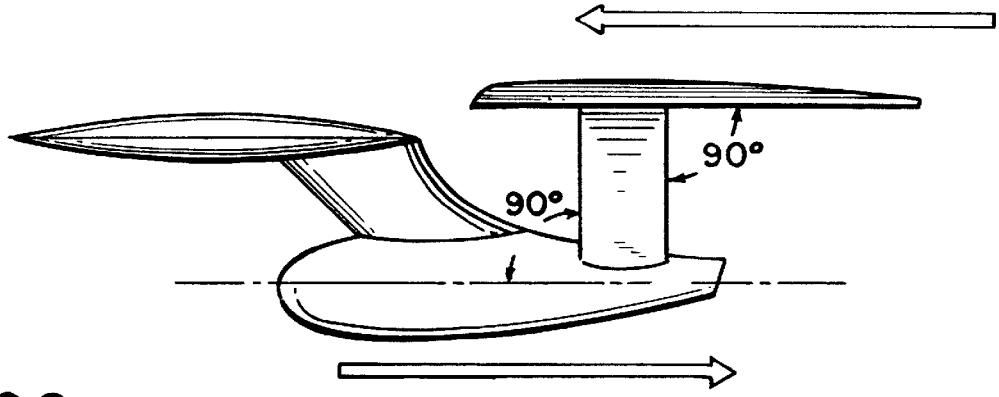
FIG.9 PRIOR ART
FIG. 9 is a side plan view of a prior art craft showing the configuration of the boom with respect to the fuselage.
Figure 10:
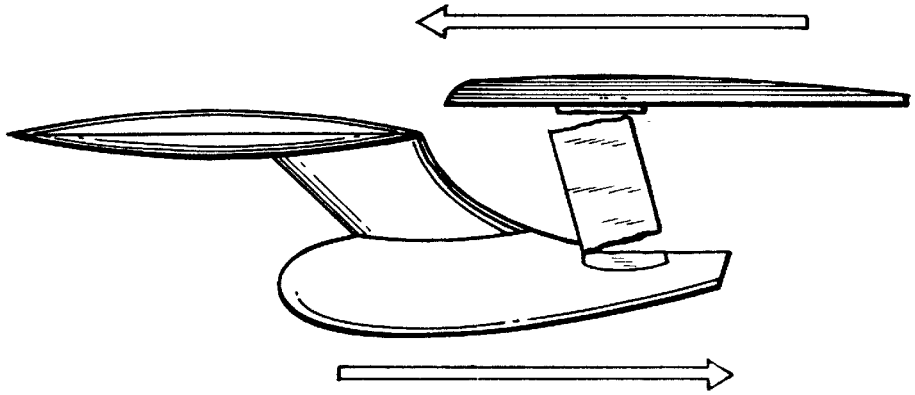
FIG.10 PRIOR ART
FIG. 10 is a side plane view of the prior art craft depicted in FIG. 9 showing the result of undue shear on the booms and fins.

Fins (See elements (74) and (75) in FIG. 7) referred to above are needed to stabilize flight. These elements serve in the dual role of a rudder/tail (vertical stabilizer) as on a conventional aircraft. A recurring problem has been that these elements are prone to fracture due to the forces generated when the model collides with obstacles particularly if the design of the embodiment disclosed in British publication GB2270478 is used. When the craft impacts head-on with an obstacle, FIG. 9 illustrates the forces acting by the arrows. With the fins protruding from the fuselage at 90 degrees or close to that angle, these forces act as a shearing force between the boom and the fuselage where fins provide very little protection against damage and will result in the fin fracturing. This sequence is shown in FIGS. 9 and 10.

After considering the sources of forces which serve in many respects to fracture these parts it was decided to considerably increase the surface area of contact to the fuselage and the area of element contact to the boom To make the fins thicker would serve to hinder its flight and would not enhance durability. The fins were aerodynamically sloped to (to the rear thereof) to provide a improved airflow around and about them.

Figure 11:
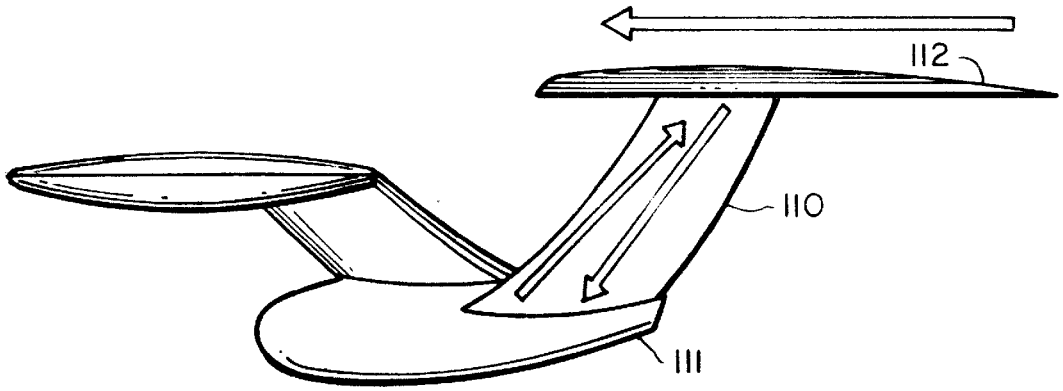
FIG. 11 is a side plan view of the craft of the present invention illustrating the forces acting about its aft section.

Finally, as shown in FIG. 11, the surface area contact of fin (110) to fuselage (111) and boom (112) has been increased. Fin (110) and its counterpart on the opposite side of the aircraft (not shown) are sloped back so as to increase surface area to the side profile of said fins, (110) and counterpart which in turn aids stability in flight and serves to redistribute any forces (illustrated by the arrows) that may occur between the booms and fuselage.

Figure 16:
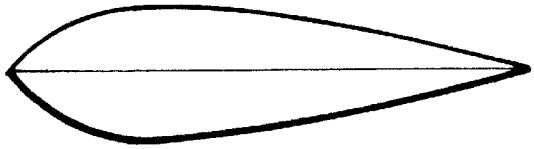
FIG. 16 is a cross section view of the fin depicted in FIG. 15 along the line 16—16.

FIG. 16 illustrates the strew ed cross section of the new fin of the aircraft of the present invention.

The arrows shown in FIGS. 9 and 10 show the forces acting on the boom and fuselage with respect to the fin. FIG. 10 shows the result if sufficient force is used. The positioning of the fins at 90 degrees to the fuselage and booms offers little protection against a fracture occurring.

Figure 15:
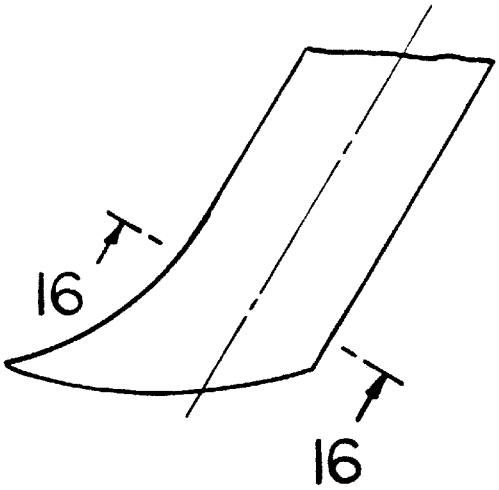
FIG. 15 is a side plan view of a fin used in the craft of the present invention.

FIGS. 3, 11 and 15 demonstrate the new swept back fin design which advantageously modifies both the structure, in terms of redistribution of forces (See FIG. 11 for the forces indicated by arrows) and f stability, in terms of increasing the side profile area of the fin which will assist the efficiency of flight by acting as larger "rudders."

FIG. 16 shows an enlarged cross section of the fin, along 16—16 in FIG. 15. The fin is streamlined resembling a conventional airfoil section.

Like conventional model aircraft, placing ballast on a craft capable of flying, to distribute its weight is essential For optimum results the amount of ballast was tested until a perfect glide was achieved under a relatively fast launch. Fine adjustments of ballast may be required for more ambitious results and then the model is suspended along its length to determine where the "center of gravity" is positioned. The ballast is positioned in the foresection of the circular wing so as to achieve a center of gravity point which generally will be approximately two thirds the diameter of the airfoil (circular wing), measured from the leading edge of the airfoil (circular wing).

Again, with most conventional type aircraft the further rearward toward the center of gravity the ballast is placed, the heavier it needs to be, which generally speaking, means a heavier and faster craft. As noted above, with respect to the aircraft of the present invention, an example of the location of the approximate positioning of the optimum ballast location (37) and the center of gravity (38) is depicted in FIG. 3(*a*).

EXAMPLE

A model U.S.S. Starship Enterprise was constructed which incorporated the changes needed to enable the model space craft to fly efficiently. The model craft constructed was initially based upon the publication disclosure found in publication GB2270478 as depicted in FIGS. 1 to 6 of that publication There are four modifications made to the model space craft which resulted in the article of the present invention The airfoil element comprising the circular wing is convex on both sides. The wing of the prior art design followed a typical airfoil section of a typical wing which is less convex on the underside than on the top. The lift that is produced when using this approach is very high and therefore requires a great deal of ballast on the craft to compensate for the lift factor. Firstly, this produces a heavier craft and secondly, it will fly at a higher speed. These two factors will, for all model aircraft, promote a higher mortality rate. It has therefore been necessary to reduce the lift, indeed reversing current airfoil design convention to the extent that the underside becomes more convex than the top as shown in FIGS. 3, 4, 7, 8, 11 and 12.

This change unexpectedly: (a) reduces ballast requirements so reducing gliding/flying speed, which in turn makes flying into obstacles less hazardous. An impact with less weight at a slower speed increases durability of the craft, and significantly increases the ability for slower, more gentle gliding.

The tailfins as shown in FIG. 3 were previously placed perpendicular to the fuselage in the prior art version as depicted in FIG. 2. Surprisingly, this was actually a structural flaw in the design. The leverage produced from the boom through the tailfin is high enough upon impact, to fracture the tailfin with ease. This segment was redesigned The new design allows (a) more surface area contact between the base of the tailfin and the fuselage; and (b) slopes the tailfins rearward. The much larger tailfin in the models tested for flight, created effective protection against any fracturing by absorbing any shocks and distributing the force through the tailfins into the fuselage.

The fuselage also had a tendency to fracture upon impact in flight for the identical reasons that the tailfins fracture. This problem has been completely solved by inserting a structural spine/brace through the center of the fuselage. (See FIG. 4.) As with the tailfins, this addition creates effective protection against any fracturing due to leverage from the booms and tailfins and absorbs any shocks with greater efficiency.

A critically important change to the design was the repositioning of the booms. In the original design, the horizontal plane of the booms, whilst positioned above the horizontal plane of the circular wing, are affected by the turbulence created from the circular wing in flight. This made for an affected flight and reduced stability. As in FIG. 3, the horizontal plane of the booms, is parallel to the horizontal plane of the circular wing, and is significantly high enough to escape the turbulence. Further, slight tilt of between about 1.0 and 1.5 degrees applied to the booms, as is shown in FIG. 3(*a*), resulted in a totally unexpected improved performance as detailed below.

The changes detailed above in the models tested substantially improved durability and also improved the flight capabilities for, not only a smooth. stable glide, but stunt flying such as a "loop the loop." Although the new design of the flying model has changed in shape considerably from the original flying version, it has all the appearance characteristics of the original fictional model.

The test model space ships reached a height of 40 ft from hand launch and glided from that height. When flown in a straight line from this height (40 ft) the model glided up to about 150 feet in very calm/no wind conditions. (The glide slope was calculated at approximately 1 foot descent for every 4 feet glided). The length of glide path varied depending on weather conditions, which when ideal, greatly increases the gliding distance. (Ideal conditions for flying are a hot breezy day (e.g., 90 degrees F and above; wind velocity of 15 knots or greater) conducted on an open area of uncut grass, obviously with as few obstacles in the area as possible.

Flight tests on space ship models having the above disclosed improvements resulted in enhanced durability of the structure of the model itself and improved flight performance.

The tests noted herein were run with, among others, a 160 mm wing version. A preferred embodiment having an 80 mm wing version was also tested and demonstrated excellent performance and durability.

Thus, while the have been shown and described and pointed out fundamental novel features of the invention as applied to currently preferred embodiments thereof it will be understood that various omissions and substitutions and changes in the form and details of the method used and flying space ship model illustrated, and in their operation, may be made by those skid in the art without departing from the spirit of the invention. In addition it is to be understood that the drawings are not necessarily drawn to scale but that they are merely conceptual in nature. It is the intention, therefore, to be limited only as indicated by the scope of the claims appended herewith.

What I claim and desire to protect by Letters Patent is:

1. A model space craft suitable for gliding comprising:

a fixed circular wing means for providing lift, having a topside and an underside and a thickness, said underside of said fixed circular wing being more convex than said topside of said circular wing;

said fixed circular wing having an approximate diameter 8 times that of its thickness;

a streamlined fuselage which extends fore and aft along a longitudinal axis about which said model space craft can assume a roll attitude;

connecting means extending from said underside of said circular wing, protruding downward and rearward and attached to a fore section location on said streamlined fuselage;

said streamlined fuselage having a tapered profile toward the aft section thereof;

said streamlined fuselage being reinforced using a light-weight stress bearing strut extending the length of said fuselage as measured from a point of said fuselage where said fuselage meets said circular wing, to a rear of said fuselage;

a pair of fins protruding from opposite sides of said streamlined fuselage and positioned and fixed at a first end to said aft of said streamlined fuselage, and extending outward radially at an angle of approximately 40 degrees from the vertical axis and rearward at an angle of approximately 30 degrees to the vertical;

each said fin being approximately 4 times wider than their thickness and having a streamlined profile to promote effective stability to said model space craft;

each said fin at its upper end supports a boom at a height above the horizontal plane of said circular wing so as to avoid said booms being subjected to the turbulence which is produced by airflow over said circular wing;

the relative dimensions of the length, width and thickness of each said boom is approximately 5 times as long as it is wide and approximately 4 times wider than it is thick;

each said boom comprises a flat underside and a domed topside with a rearward taper;

each said boom lies on a horizontal plane parallel to the horizontal plane of said fixed circular wing with a slight tilt of between about 1.0 degrees and 1.5 degrees clockwise viewed from a left side of said model space ship;

a ballast is positioned in the foresection of the circular wing so as to achieve a center of gravity point which is approximately two thirds the diameter of said circular wing, measured from the leading edge of said circular wing.

2. A model space craft as defined in claim 1, wherein said fuselage is comprised of multiple sections with additional support internally.

3. A model space craft as defined in claim 1, wherein said fuselage is comprised of single sections with additional support internally.

4. A model space craft as defined in claim 1, wherein said fuselage is comprised of multiple sections with additional support externally.

5. A model space craft as defined in claim 1, wherein said fuselage is comprised of single sections with additional support externally.

6. The model space craft as defined in claim 1, wherein the craft is powered by propulsion means selected from the group consisting of electric, combustible fuel, elastic or compressed air, where said propulsion means is mounted internally.

7. The model spacecraft as defined in claim 1, wherein the craft is powered by propulsion means selected from the group consisting of electric, combustible fuel, elastic or compressed air, where said propulsion means is mounted externally on the craft and where propulsion units are attached or detached from the craft.

8. The model space craft as defined in claim 7, wherein said propulsion units on said craft are mounted externally.

9. The model space craft as defined in claim 7, wherein said propulsion units on said craft are mounted internally.

10. The model space craft as defined in claim 7, wherein said propulsion units on said craft are attached to said craft.

11. The model space craft as defined in claim 7, wherein said propulsion units on said craft are detached from said craft.

12. The model space craft as defined in claim 1 wherein said craft is propelled by means selected from the group consisting of a catapult, by throwing or by a manually powered device.

13. The model space craft as defined in claim 1 wherein said craft is selected from the group consisting of a flying toy, a flying commercial vehicle, a flying recreational vehicle, a flying military vehicle, and a flying scientific vehicle.

* * * * *